US008934804B2

(12) United States Patent
Suzuki et al.

(10) Patent No.: US 8,934,804 B2
(45) Date of Patent: Jan. 13, 2015

(54) STAY AND GUIDE CONFIGURATIONS FOR A FUSER UNIT

(71) Applicants: Noboru Suzuki, Komaki (JP); Kei Ishida, Nishi-ku (JP); Takuji Matsuno, Ichinomiya (JP); Tomohiro Kondo, Minami-ku (JP); Hisashi Tsukawaki, Atsuta-ku (JP); Seiji Hiramatsu, Showa-ku (JP)

(72) Inventors: Noboru Suzuki, Komaki (JP); Kei Ishida, Nishi-ku (JP); Takuji Matsuno, Ichinomiya (JP); Tomohiro Kondo, Minami-ku (JP); Hisashi Tsukawaki, Atsuta-ku (JP); Seiji Hiramatsu, Showa-ku (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 218 days.

(21) Appl. No.: 13/625,091

(22) Filed: Sep. 24, 2012

(65) Prior Publication Data

US 2013/0136512 A1 May 30, 2013

(30) Foreign Application Priority Data

Nov. 29, 2011 (JP) ..... 2011-260491
Nov. 29, 2011 (JP) ..... 2011-260512

(51) Int. Cl.
*G03G 15/20* (2006.01)

(52) U.S. Cl.
USPC ..... 399/90; 399/329

(58) Field of Classification Search
CPC ..... G03G 15/2053; G03G 2215/2025; G03G 2215/2035
USPC ..... 399/90, 329
See application file for complete search history.

(56) References Cited

U.S. PATENT DOCUMENTS

| | | | | |
|---|---|---|---|---|
| 5,525,775 | A | 6/1996 | Setoriyama et al. | |
| 8,660,445 | B2 * | 2/2014 | Ishida et al. | 399/329 |
| 2011/0158718 | A1 | 6/2011 | Fujiwara et al. | |

FOREIGN PATENT DOCUMENTS

| | | | |
|---|---|---|---|
| JP | 04-044075 | A | 2/1992 |
| JP | 2011-095534 | A | 5/2011 |

* cited by examiner

*Primary Examiner* — William J Royer
(74) *Attorney, Agent, or Firm* — Banner & Witcoff, Ltd.

(57) ABSTRACT

A fuser unit, which heat-fixes a developer image on a recording sheet, the fuser unit including: a cylindrical member having flexibility; a heat generation member; a nip member; a stay; a first frame; a second frame, and a wiring, wherein the first frame is provided with a pair of openings through which both axial end sides of the stay are exposed, wherein the second frame is configured to cover a central portion of the wiring, which is positioned at an inward side more than the pair of openings in the axial direction, wherein both axial sides of the second frame are provided with pressing protrusions that directly press the stay through the openings, and wherein both axial sides of the second frame are provided with third frames that cover a part of the wiring arranged at both axial end sides of the first frame.

15 Claims, 8 Drawing Sheets

STAY AND GUIDE CONFIGURATIONS FOR A FUSER UNIT

CROSS-REFERENCE TO RELATED APPLICATION

This application claims priority from Japanese Patent Applications No. 2011-260491 filed on Nov. 29, 2011, and No. 2011-260512 filed on Nov. 29, 2011, the entire subject matter of which is incorporated herein by reference.

TECHNICAL FIELD

This disclosure relates to a fuser unit that heat-fixes a developer image on a recording sheet.

Specially, this disclosure relates to a fuser unit including a cylindrical member having flexibility, a nip member slidingly contacting an inner periphery of the cylindrical member and a backup member that forms a nip portion by sandwiching the cylindrical member between the nip member and the backup member.

BACKGROUND

Currently, a fuser unit includes a nip plate, to which radiation heat from a halogen lamp is applied, and a stay supporting the nip plate while surrounding the halogen lamp (refer to JP-A-2011-95534).

Meanwhile, a fuser unit having a cylindrical member, a nip member and a backup member has been known which includes a guide member slidingly contacting an inner periphery of the cylindrical member and guiding the cylindrical member toward a nip portion and an end restraint member restraining a position of an end of the cylindrical member (refer to JP-A-4-44075). Specifically, according to this art, the end restraint member is attached to the guide member so that it is adjacent to an end of the guide member.

SUMMARY

According to JP-A-2011-95534, the stay is provided at an opposite side to the nip plate with two cover members overlapping each other up and down, and a wiring for feeding electricity to the halogen lamp and the like is arranged between the two cover members. In this case, the stay is pressed through the two cover members to thus urge the nip plate toward a pressing roller, thereby forming a nip portion for heat-fixing a toner image on a sheet.

However, when the stay is pressed through the two cover members, a balance of pressing the stay is deteriorated due to a manufacturing error of each cover member, so that fixing performance may be lowered.

Accordingly this disclosure provides at least a fuser unit capable of pressing a stay with good balance to improve fixing performance.

Meanwhile, according to the JP-A-4-44075, the end restraint member is adjacent to end of the guide member. Therefore, when a gap is caused between the end of the guide member and the end restraint member due to an error, the cylindrical member is introduced into the gap and thus deformed, so that the end of the cylindrical member is damaged. More specifically, as the cylindrical member is pulled toward the nip portion, the cylindrical member is strongly pressed to a part of the guide member, which is positioned at an upstream side of the nip portion. As a result, a gap is formed between the part and the end restraint member, so that the above problem is caused.

Accordingly, this disclosure also provides at least a fuser unit capable of suppressing an end of a cylindrical member from being damaged.

A fuser unit of this disclosure heat-fixes a developer image on a recording sheet. The fuser unit comprises: a cylindrical member having flexibility; a heat generation member; a nip member; a stay; a first frame; a second frame, and a wiring. Here, the 'wiring' is a wiring for transmitting electricity. The cylindrical member has flexibility. The heat generation member is arranged at an inside of the cylindrical member. The nip member is arranged inside the cylindrical member and to which radiation heat generated from the heat generation member is applied. The stay supports the nip member while surrounding the heat generation member. The first frame is arranged at an opposite side to the nip member with respect to the stay. The second frame is arranged at an opposite side to the stay with respect to the first frame. The wiring is arranged to extend in an axial direction of the cylindrical member between the first frame and the second frame. The first frame is provided with a pair of openings through which both axial end sides of the stay are exposed, and the second frame is configured to cover a central portion of the wiring, which is positioned at an inward side more than the pair of openings in the axial direction, both axial sides of the second frame are provided with pressing protrusions that directly press the stay through the openings, and both axial sides of the second frame are provided with third frames that cover a part of the wiring arranged at both axial end sides of the first frame.

According to the above configuration, since the stay is directly pressed by the pressing protrusions of the third frames, it is possible to reduce an influence of an error of a part, compared to a structure where the stay is pressed via two covers. Accordingly, it is possible to press the stay with good balance.

A fuser unit of this disclosure heat-fixes a developer image on a recording sheet. The fuser unit comprises: a cylindrical member; a nip member; a backup member; an upstream guide; and an end restraint member. The cylindrical member has flexibility. The nip member slidingly contacts an inner periphery of the cylindrical member. The backup member forms a nip portion by sandwiching the cylindrical member between the nip member and the backup member and rotates together with the cylindrical member. The upstream guide is provided at an upstream side of the nip portion in a rotating direction of the cylindrical member to guide the cylindrical member toward the nip portion. The end restraint member has a restraint surface that restrains a position of an end of the cylindrical member. The upstream guide is formed to protrude more than the restraint surface outward in an axial direction of the cylindrical member.

According to the above configuration, the upstream guide protrudes more than the restraint surface outward in the axial direction. Thus, since it is possible to suppress a gap from being formed between the upstream guide and the restraint surface in the axial direction, it is possible to suppress that an end of the cylindrical member is introduced into a gap between the restraint surface and the upstream guide and thus deformed and damaged.

BRIEF DESCRIPTION OF THE DRAWINGS

The foregoing and additional features and characteristics of this disclosure will become more apparent from the following detailed descriptions considered with reference to the accompanying drawings, wherein.

DETAILED DESCRIPTION

Hereinafter, illustrative embodiments of this disclosure will be specifically described with reference to the drawings. In the below descriptions, a schematic configuration of a laser printer 1 (image forming apparatus) having a fuser unit 100 according to an illustrative embodiment of this disclosure will be briefly described and then a specific configuration of the fuser unit 100 will be described.

Also, in the below descriptions, the directions are described on the basis of a user who uses the laser printer 1. That is, the left side of FIG. 1 is referred to as the 'front', the right side is referred to as the 'rear', the front side is referred to as the 'right' and the back side is referred to as the 'left.' Also, the upper-lower direction of FIG. 1 is referred to as the 'upper-lower.'

<Schematic Configuration of Laser Printer>

Figure 1:
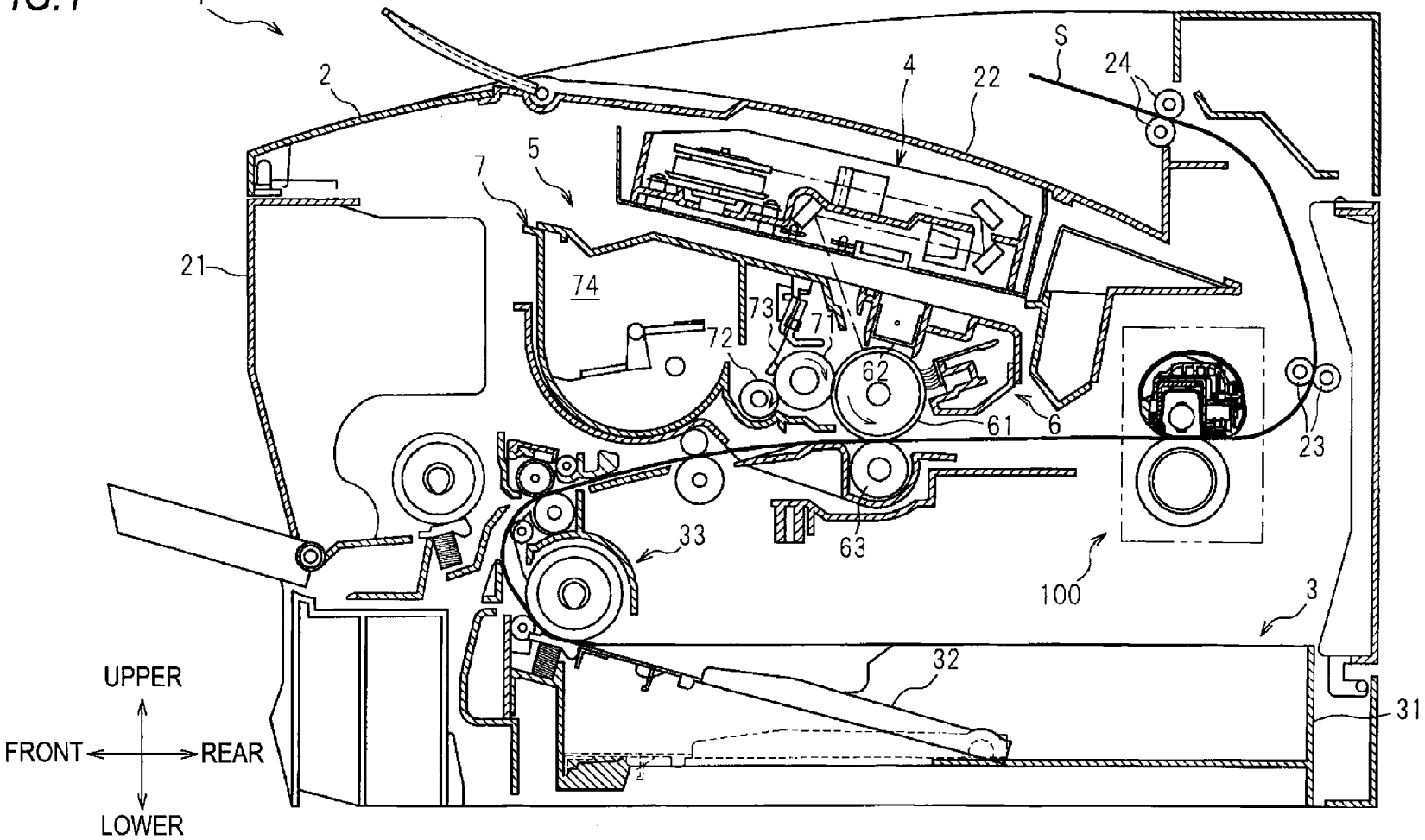
FIG. 1 is a sectional view illustrating a laser printer having a fuser unit according to an illustrative embodiment of this disclosure.

As shown in FIG. 1, the laser printer 1 mainly has, in a body housing 2, a feeder unit 3 that feeds a sheet S, which is an example of a recording sheet, an exposure device 4, a process cartridge 5 that transfers a toner image (developer image) on the sheet S and the fuser unit 100 that heat-fixes the toner image on the sheet S.

The feeder unit 3 is provided at a lower part in the body housing 2 and mainly has a sheet feeding tray 31, a sheet pressing plate 32 and a sheet feeding mechanism 33. The sheet S accommodated in the sheet feeding tray 31 is upwardly displaced by the sheet pressing plate 32 and is fed toward the process cartridge 5 (between a photosensitive drum 61 and a transfer roller 63) by the sheet feeding mechanism 33.

The exposure device 4 is arranged at an upper part in the body housing 2 and has a laser emitting unit (not shown), a polygon mirror, a lens, a reflector and the like whose reference numerals are omitted. In the exposure device 4, a laser light (refer to the dotted-dashed line) based on image data, which is emitted from the laser emitting unit, is scanned on a surface of the photosensitive drum 61 at high speed, thereby exposing the surface of the photosensitive drum 61.

The process cartridge 5 is disposed below the exposure device 4 and is detachably mounted to the body housing 2 through an opening that is formed when a front cover 21 provided to the body housing 2 is opened. The process cartridge 5 has a drum unit 6 and a developing unit 7.

The drum unit 6 mainly has the photosensitive drum 61, a charger 62 and the transfer roller 63. Also, the developing unit 7 is detachably mounted to the drum unit 6 and mainly has a developing roller 71, a supply roller 72, a layer thickness regulation blade 73 and a toner accommodation unit 74 that accommodates toner, which is an example of the developer.

In the process cartridge 5, the surface of the photosensitive drum 61 is uniformly charged by the charger 62 and then exposed by the high-speed scanning of the laser light emitted from the exposure device 4, so that an electrostatic latent image based on image data is formed on the photosensitive drum 61. Also, the toner in the toner accommodation unit 74 is supplied to the developing roller 71 via the supply roller 72, is introduced between the developing roller 71 and the layer thickness regulation blade 73 and is carried on the developing roller 71 as a thin layer having a predetermined thickness.

The toner carried on the developing roller 71 is supplied from the developing roller 71 to the electrostatic latent image formed on the photosensitive drum 61. Thereby, the electrostatic latent image becomes visible and a toner image is thus formed on the photosensitive drum 61. Then, the sheet S is conveyed between the photosensitive drum 61 and the transfer roller 63, so that the toner image on the photosensitive drum 61 is transferred onto the sheet S.

The fuser unit 100 is arranged at the rear of the process cartridge 5. The toner image transferred on the sheet S passes through the fuser unit 100, so that the toner image is heat-fixed on the sheet S. Then, the sheet S is discharged on a sheet discharge tray 22 by conveyance rollers 23, 24.

<Detailed Configuration of Fuser Unit>

Figure 2:
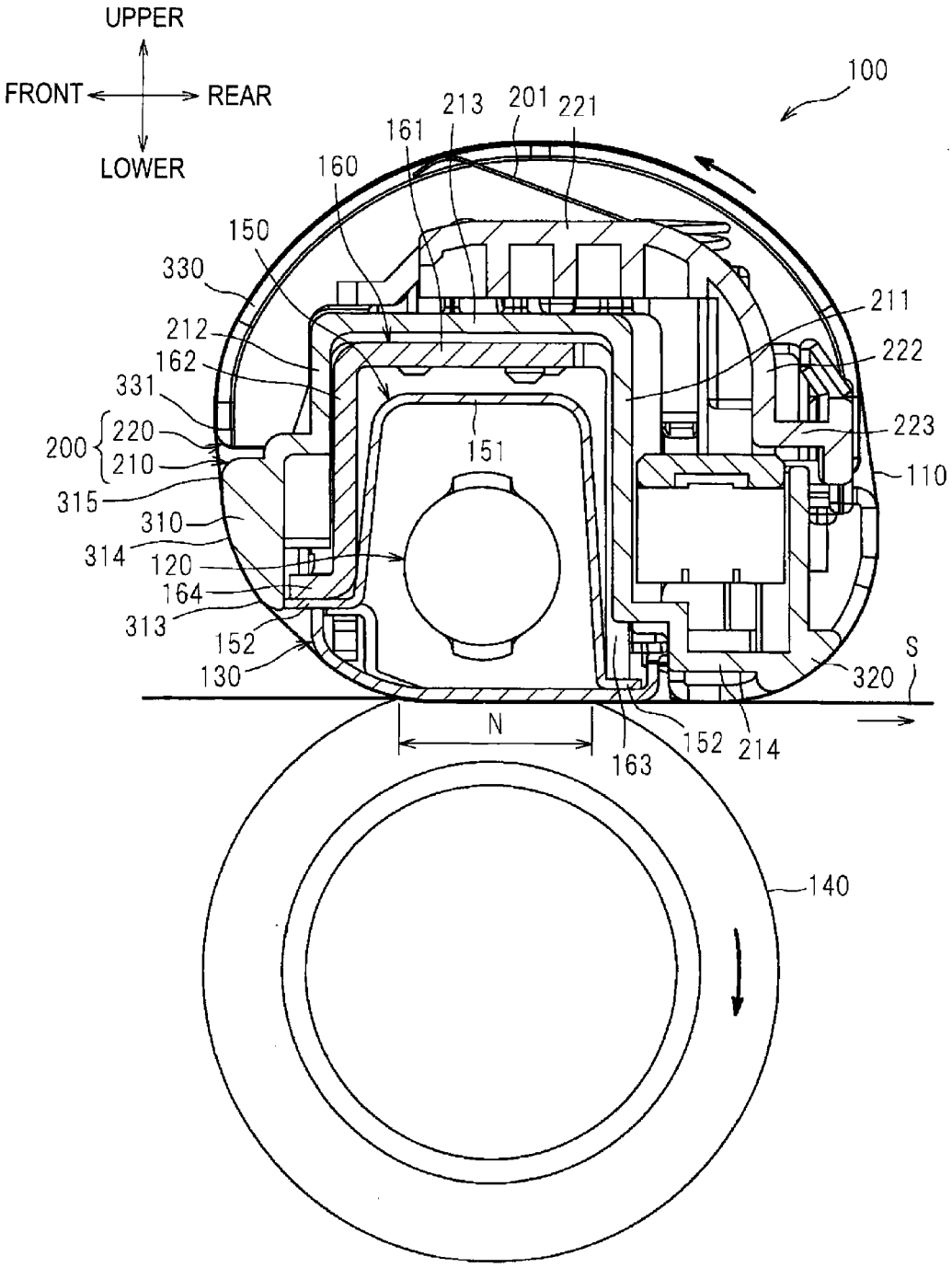
FIG. 2 is a sectional view illustrating the fuser unit.

As shown in FIG. 2, the fuser unit 100 mainly has a fixing belt 110 that is an example of the cylindrical member, a halogen lamp 120 that is an example of the heat generation member, a nip plate 130 that is an example of the nip member, a pressing roller 140 that is an example of the backup member, a reflection plate 150, a stay 160 and a cover member 200.

The fixing belt 110 is a belt of an endless shape (cylindrical shape) having heat resistance and flexibility and rotation thereof is guided by a guide part (an upstream guide 310, a downstream guide 320 and end portion guides 330) that is provided to the cover member 200, which will be described later. Specifically, in this illustrative embodiment, the fixing belt 110 consists of a metal belt having a base member made of metal and a resin that covers an outer periphery of the base member.

Also, the fixing belt 110 is urged in a diametrically outward direction with a weak urging force by a wire spring 201 provided to the cover member 200. Thereby, the fixing belt 110 is applied with tension by the wire spring 201 and is also configured to diametrically move.

In the meantime, the member for applying the tension to the fixing belt 110 is not limited to the wire spring 201. For example, a plate spring may be also used. Also, the wire spring 201 is not necessarily provided. That is, the wire spring 201 may be omitted so that the fixing belt 110 is diametrically moved.

The halogen lamp 120 is a member that generates radiation heat to thus heat the nip plate 130 and the fixing belt 110 (nip portion N), thereby heating the toner on the sheet S. The halogen lamp 120 is arranged at an inside of the fixing belt 110 at a predetermined interval from inner surfaces of the fixing belt 110 and the nip plate 130.

The nip plate 130 is a plate-shaped member to which the radiation heat from the halogen lamp 120 is applied, and is arranged at the inside of the fixing belt 110 so that a lower surface thereof slidingly contacts an inner periphery of the fixing belt 110. In this illustrative embodiment, the nip plate 130 is formed by bending a metal plate, for example an aluminum plate and the like having thermal conductivity higher than the stay 160 made of steel, which will be described later. In the meantime, when the nip plate 130 is made of aluminum, it is possible to improve the thermal conductivity of the nip plate 130.

The pressing roller 140 is a member that interposes the fixing belt 110 between the nip plate 130 and the pressing roller 140 to thus form the nip portion N between the fixing belt 110 and the pressing roller 140, and is arranged below the nip plate 130. In this illustrative embodiment, in order to form the nip portion N, one of the nip plate 130 and the pressing roller 140 is urged toward the other. The pressing roller 140 rotates with the fixing belt 110 being positioned between the nip plate 130 and the pressing roller 140, so that the pressing roller 140 rotates together with the fixing belt 110 to thus convey the sheet S rearward.

The pressing roller 140 is configured to rotate as a driving force is transferred thereto from a motor (not shown) provided in the body housing 2. As the pressing roller 140 rotates, the pressing roller 140 rotates the fixing belt 110 by a frictional force with the fixing belt 110 (or sheet S). Thereby, the sheet S having the toner image transferred thereto is conveyed between the pressing roller 140 and the heated fixing belt 110 (through the nip portion N), so that the toner image (toner) is heat-fixed.

The reflection plate 150 is a member that reflects the radiation heat from the halogen lamp 120 toward the nip plate 130, and is arranged at a predetermined interval from the halogen lamp 120 so that the reflection plate 150 covers the halogen lamp 120 at the inside of the fixing belt 110.

The reflection plate 150 is formed by bending a metal plate such as an aluminum plate and the like having high reflectance of the infrared and far-infrared into a substantial U shape, when seen from a section. More specifically, the reflection plate 150 has a reflection part 151 having a U shape and flanges 152 extending from both front and rear ends (respective ends at sides facing the nip plate 130) of the reflection part 151 toward the outside in the front-rear direction.

The respective flanges 152 are positioned between the stay 160 and the nip plate 130.

The stay 160 is a member that supports the nip plate 130 via the reflection plate 150 and thus bears load from the pressing roller 140, and is arranged to surround the halogen lamp 120 and the reflection plate 150 at the inside of the fixing belt 110. In the meantime, the load that is here described means a reactive force to a force with which the nip plate 130 urges the pressing roller 140, in a configuration where the nip plate 130 urges the pressing roller 140.

Specifically, the stay 160 has a U-shaped section by an upper wall 161, a front wall 162 extending downward from a front end of the upper wall 161 and a rear wall 163 extending downward from a rear end of the upper wall 161. A lower end portion of the front wall 162 is formed with a flange 164 extending forward.

The stay 160 is formed by bending a steel plate and the like having relatively high rigidity.

The cover member 200 mainly has a first cover member 210 made of resin, which is an example of the first frame, and a second cover member 220 made of resin, which is an example of the second frame.

The first cover member 210 has a U-shaped section, extends in the left-right direction and is arranged to cover the stay 160 from an opposite side to the halogen lamp 120 while sandwiching the stay 160 therebetween. In other words, the first cover member 210 is arranged at an opposite side to the nip plate 130 with respect to the stay 160.

The first cover member 210 mainly has a rear side wall 211, a front side wall 212, an upper wall 213 connecting upper ends of the rear side wall 211 and the front side wall 212 and an extension wall 214 extending rearward from a lower end of the rear side wall 211.

A lower end portion of the front side wall 212 is formed with the upstream guide 310 that guides a front lower part of the fixing belt 110. Also, a rear end of the extension wall 214 is formed with the downstream guide 320 that guides a rear lower part of the fixing belt 110.

The upstream guide 310 is provided at a upstream side more than the nip portion N in a rotating direction of the fixing belt 110 and guides the fixing belt 110 toward the nip portion N. The upstream guide 310 protrudes downward (toward the nip plate 130) more than the flange 152 of the reflection plate 150.

Thereby, it is possible to suppress the fixing belt 110 from being caught at the flange 152 of the reflection plate 150 by the upstream guide 310.

Figure 3:
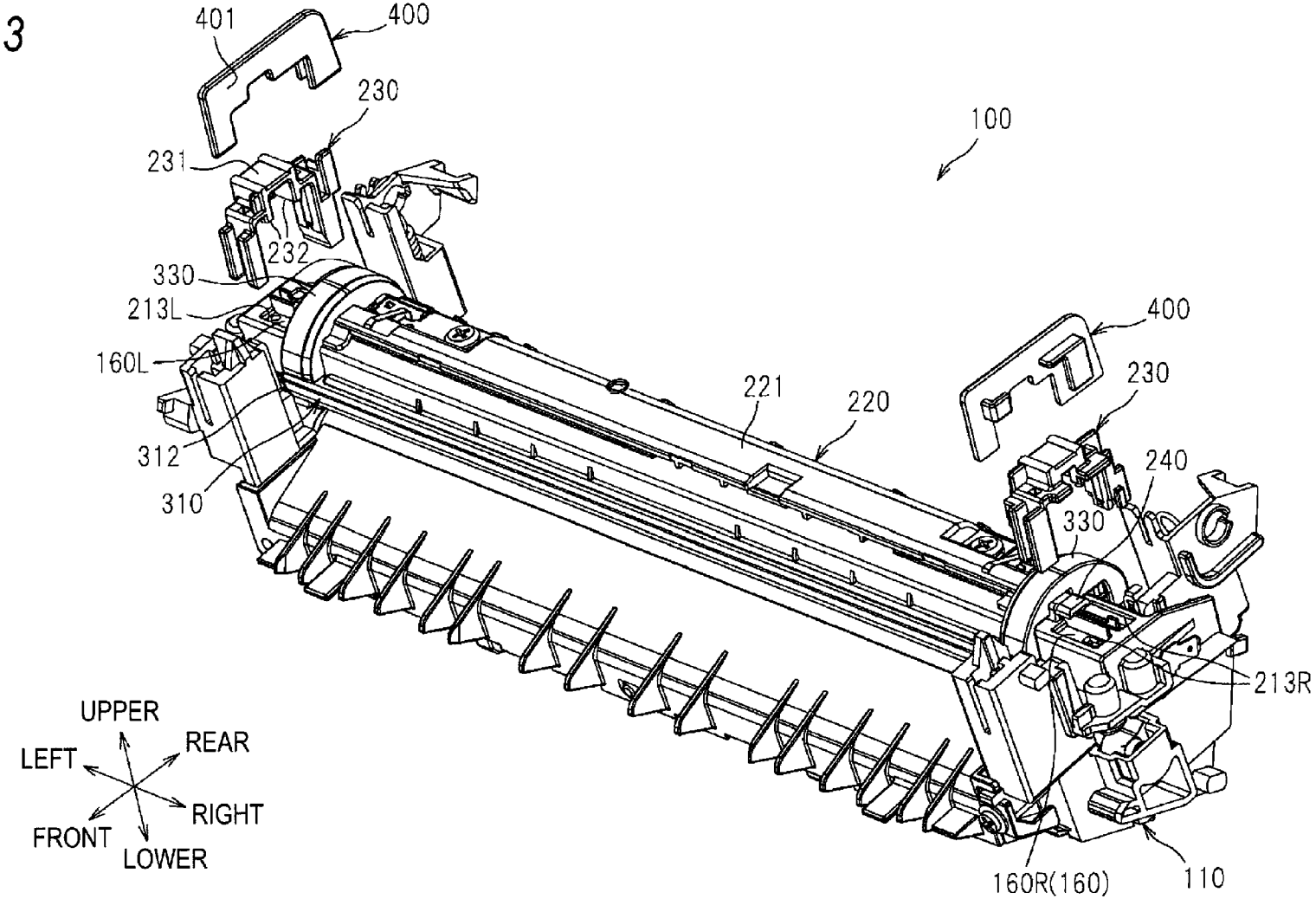
FIG. 3 is an exploded perspective view illustrating a state where end restraint members and third cover members are detached from a first cover member.
Figure 4:
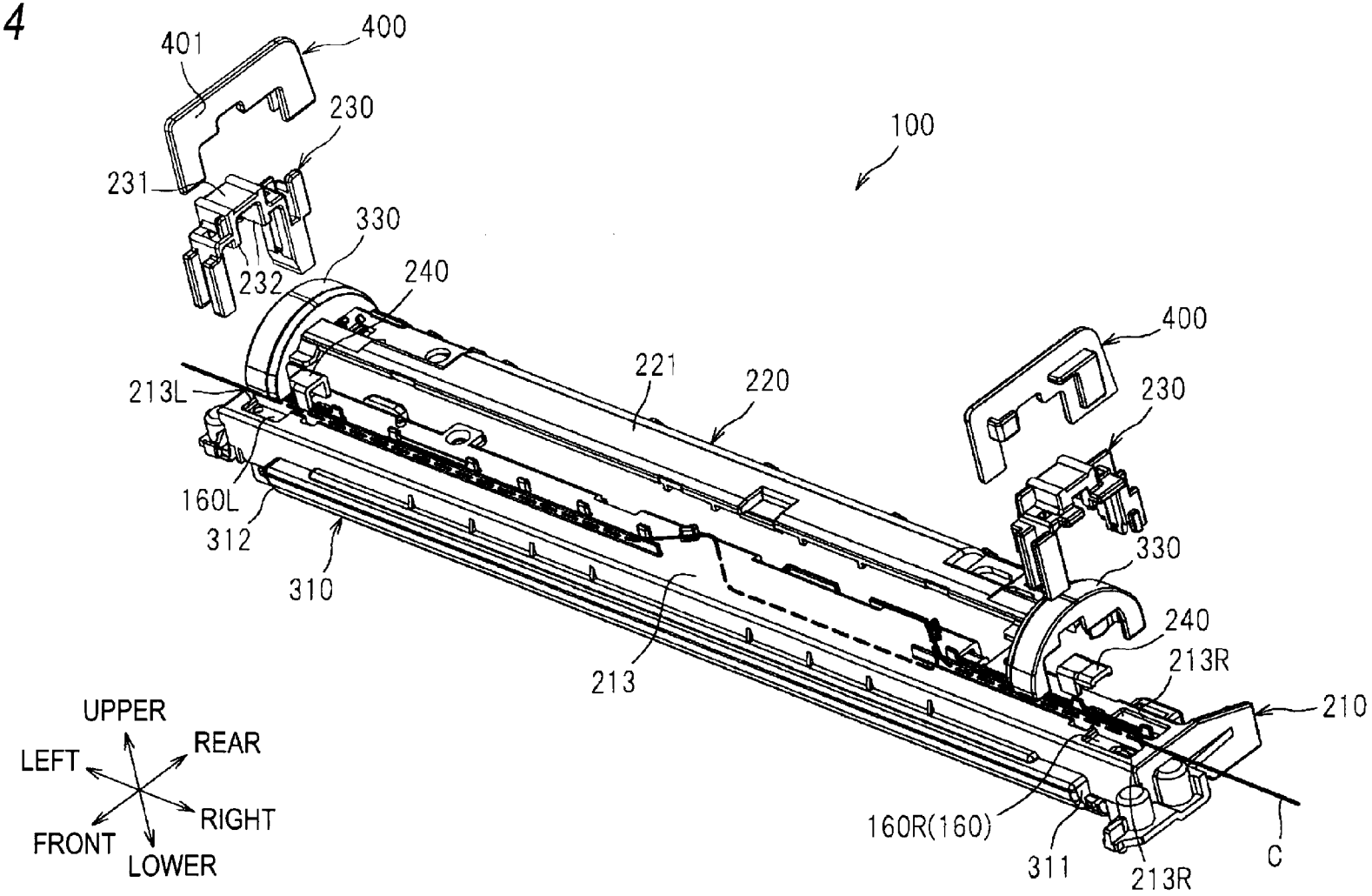
FIG. 4 is an exploded perspective view illustrating a state where a second cover member and fourth cover members are also detached from the first cover member.

Also, as shown in FIGS. 3 and 4, the upstream guide 310 extends long in the left-right direction. Upper sides (upstream sides in the rotating direction of the fixing belt 110) of both left and right end portions 311, 312 of the upstream guide 310 are provided with two end restraint members 400 having restraint surfaces 401 for restraining positions of ends 111 of the fixing belt 110 so that they are adjacent to both end portions 311, 312, respectively.

Figure 5:
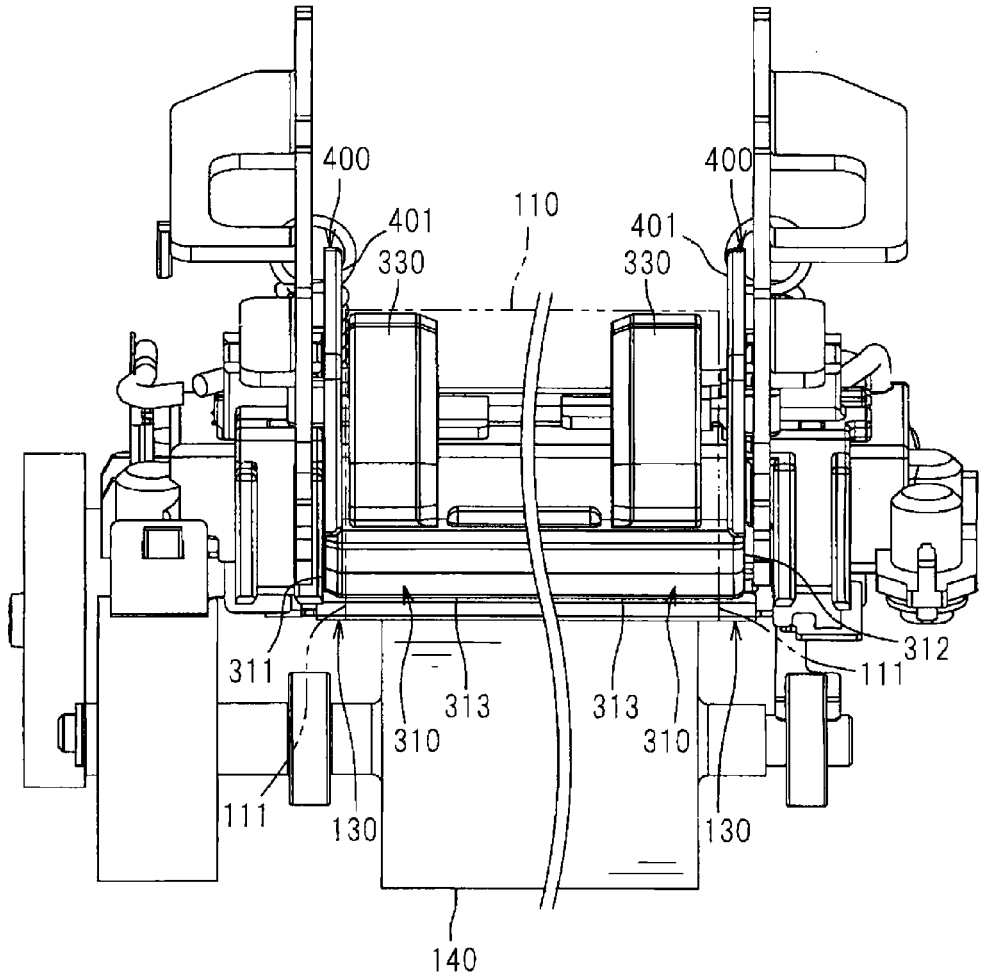
FIG. 5 is an enlarged front view illustrating a relation between both end portions of an upstream guide and the end restraint members.
Figure 5:
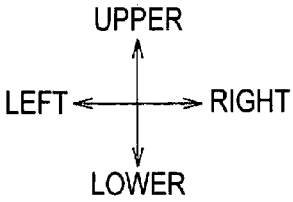

As shown in FIG. 5, the upstream guide 310 is formed so that both end portions 311, 312 thereof protrude outward (axially outer side of the fixing belt 110) more than the restraint surfaces 401 of the end restraint members 400 in the left-right direction. The upstream guide 310 protrudes outward more than the restraint surfaces 401 in the left-right direction, as described above, so that it is possible to suppress a gap from being formed between the upstream guide 310 and the restraint surfaces 401 in the left-right direction. Thus, it is possible to suppress the problem in that the ends 111 of the fixing belt 110 are introduced into gaps between the restraint surfaces 401 and the upstream guide 310 and thus deformed and damaged.

Also, a lower end portion 313 (downstream side in the rotating direction) of the upstream guide 310 is linear in the left-right direction. Thereby, it is possible to suppress the deformation of the fixing belt 110 and thus to smoothly guide the fixing belt 110 to the nip portion N, compared to a configuration where the lower end portion 313 of the upstream guide 310 is formed with unevenness.

Also, as shown in FIG. 2, a sliding contact surface 314 of the upstream guide 310, which contacts the fixing belt 110, is a surface (surface having no unevenness) conforming to the inner periphery of the fixing belt 110. Thereby, it is possible to suppress the deformation of the fixing belt 110, compared to a configuration where the sliding contact surface of the upstream guide 310 is formed with the unevenness such as ribs.

Also, as shown in FIGS. 2 to 4, the upper sides (upstream sides in the rotating direction) of both end portions 311, 312 of the upstream guide 310 are adjacently provided with a pair of end portion guides 330 that slidingly contacts the inner periphery of both end portions of the fixing belt 110 to thus guide the fixing belt 110 toward the upstream guide 310. As shown in FIG. 2, an upper end portion 315 (upstream side in the rotating direction) of the upstream guide 310 is arranged at a rear side (a diametrically inner side of the fixing belt 110)

more than lower (downstream side in the rotating direction) end portions 331 of the end portion guides 330.

Thereby, it is possible to suppress the fixing belt 110 from being caught at the upper end portion 315 of the upstream guide 310.

The second cover member 220 extends long in the left-right direction and is arranged at an upper side (opposite side to the stay 160) of the first cover member 210 so as to cover a part of the first cover member 210. The second cover member 220 mainly has an upper wall 221, a rear wall 222 extending downward from a rear end of the upper wall 221 and an extension wall 223 extending rearward from a lower end of the rear wall 222. As shown in FIG. 4, both left and right end portions of the upper wall 221 are integrally formed with the pair of end portion guides 330 that guides the upper part of the fixing belt 110.

A cable C that is an example of the wiring is provided between the first cover member 210 and the second cover member 220. The cable C is a conducting wire that feeds the electricity to the halogen lamp 120 via a thermostat (not shown) and is mainly arranged on the upper wall 213 of the first cover member 210 so that it extends in the left-right direction (axial direction of the fixing belt 110).

Figure 6:
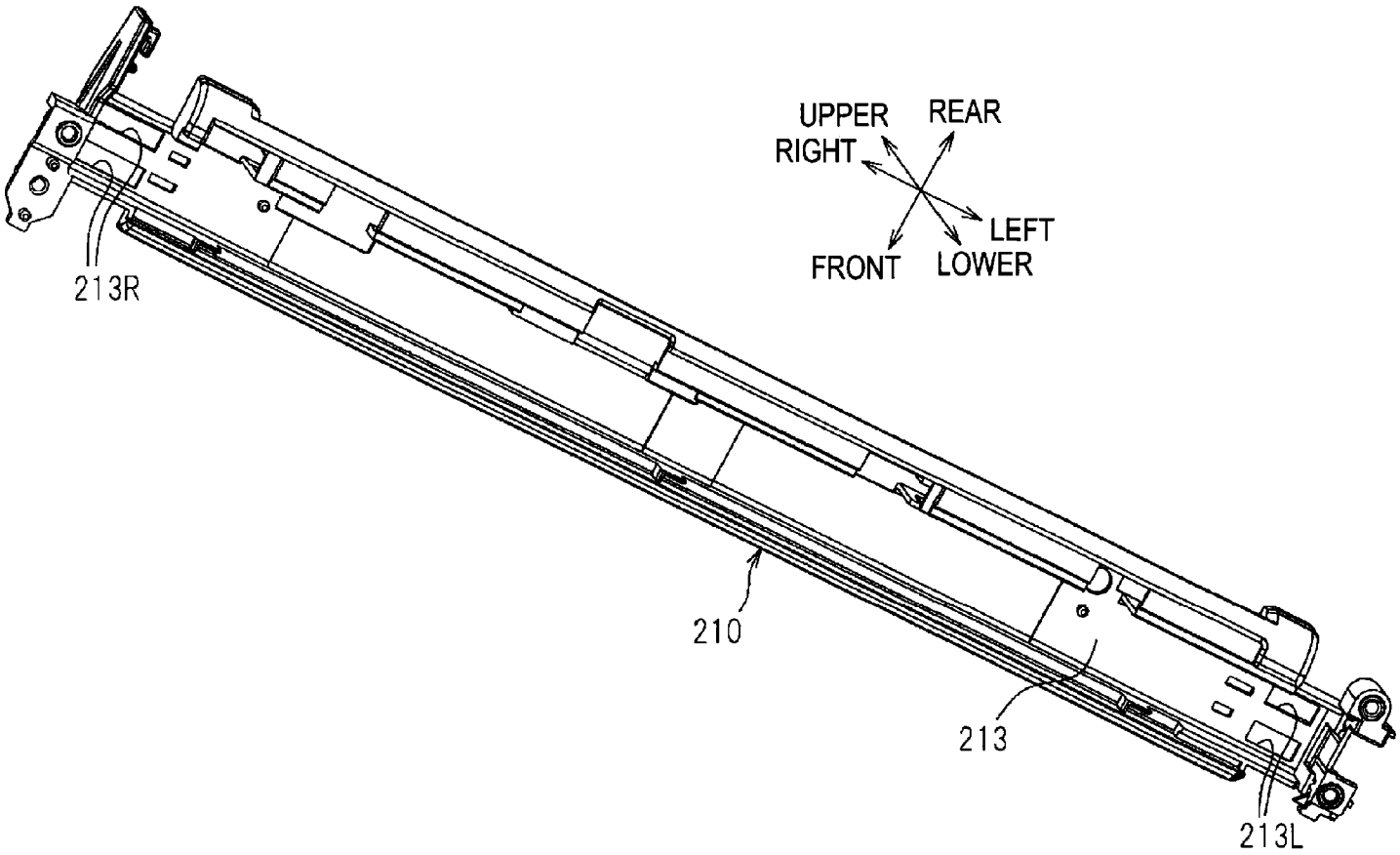
FIG. 6 is a perspective view illustrating the first cover member, which is seen from below.

Also, two left openings 213L and two right openings 213R (refer to FIG. 6) are provided on the upper wall 213 of the first cover member 210 to expose portions 160L, 160R of both left and right end sides of the stay 160. In other words, two pairs of the left openings 213L and right openings 213R are provided at an interval in the front-rear direction.

Also, the second cover member 220 is configured to cover a central part (an inward part more than the left and right openings 213L, 213R in the left-right direction) of the cable C. Both left and right sides of the second cover member 220 are provided with third cover members 230, which are an example of the third frame.

The third cover members 230 are members that cover parts of the cable C, which are arranged at both left and right end sides of the first cover member 210, and are separately provided from the end restraint members 400 and the end portion guides 330. The third cover members 230 are supported by a housing (refer to FIG. 3) of the fuser unit 100 so that the third cover members 230 can be moved in the upper-lower direction at a state where the third cover members 230 are restrained from moving in all direction.

The third cover member 230 has a U-shaped section that is opened downward, and is formed with two pressing protrusions 232 protruding downward at a bottom part 231. The two pressing protrusions 232 are provided at positions corresponding to the two left openings 213L (or two right openings 213R) and are configured to directly press the stay 160 through the left and right openings 213L, 213R.

Like this, the pressing protrusions 232 of the third cover members 230 directly press the stay 160. Thus, compared to a structure where the stay is pressed via two covers, it is possible to reduce an influence of an error of a part. Accordingly, since it is possible to press the stay 160 with good balance, it is possible to improve the fixing performance.

Here, the pressing protrusions 232 press the stay 160 when the pressing roller 140 is urged toward the nip plate 130 by an elastic member such as spring as well as when the nip plate 130 is urged toward the pressing roller 140 via the third cover members 230, the stay 160 and the reflection plate 150 by the elastic member. That is, when the pressing roller 140 is urged toward the nip plate 130, the stay 160 is urged toward the pressing protrusions 232. However, even in this case, the pressing protrusions 232 press the stay 160 by the reactive force resisting the force that is applied from the stay 160.

Also, fourth cover members 240 that are an example of the fourth frame are provided between the second cover member 220 and the third cover members 230. The fourth cover members 240 are members that cover the cable C exposed through the gaps between the second cover member 220 and the third cover members 230, and are provided to overlap with the second cover member 220 and the third cover members 230.

Like this, the fourth cover members 240 are provided to overlap with the second cover member 220 and the third cover members 230, so that it is possible to suppress the exposure of the cable C through between the respective cover members 220, 230, 240, more securely.

Figure 7B:
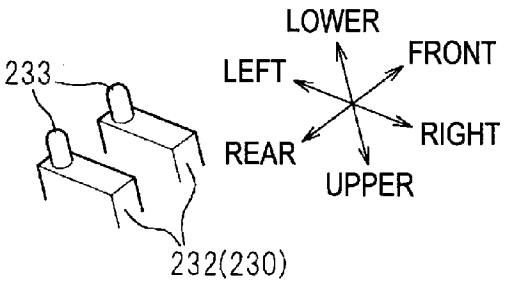
FIG. 7B is a perspective view illustrating a relation between an engaging projection and a pressing protrusion.
Figure 7A:
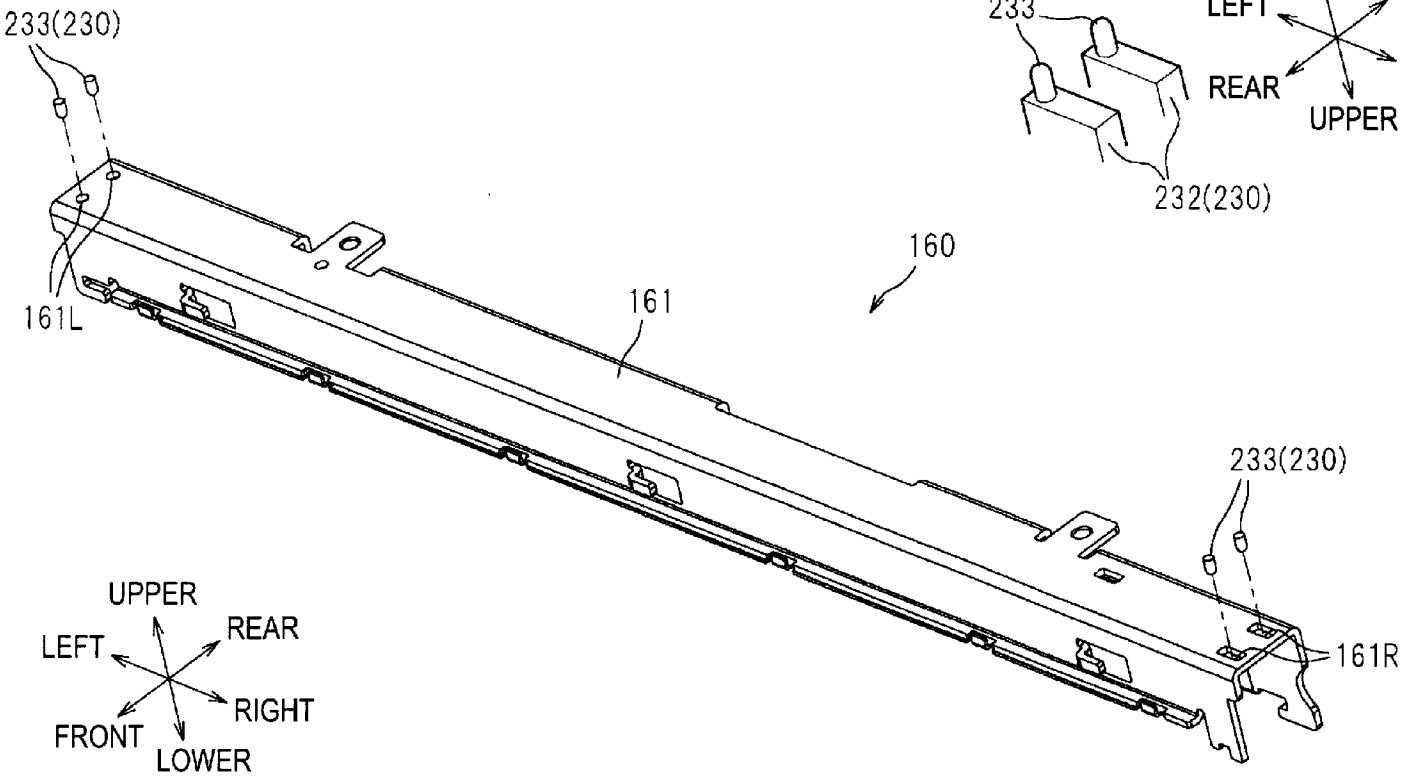
FIG. 7A is a perspective view illustrating a stay, which is seen from above.

As shown in FIG. 7A, both left and right end sides of the upper wall 161 of the stay 160 are formed with two left through-holes 161L and two right through-holes 161R, which are examples of the engaging holes into which engaging projections 233 provided to the third cover members 230 are fitted. Here, in FIG. 7A, only the engaging projections 233 of the third cover member 230 are shown.

Specifically, as shown in FIG. 7B, the engaging projection 233 is a cylindrical projection and protrudes downward from a lower surface of each pressing protrusion 232. As shown in FIG. 7A, the left through-holes 161L are respectively arranged at positions corresponding to the two left engaging projections 233 arranged at an interval in the front-rear direction and have the substantially same inner diameter as an outer diameter of the engaging projection 233, respectively.

The right through-holes 161R are respectively arranged at positions corresponding to the two right engaging projections 233 arranged at an interval in the front-rear direction and are formed as long holes in the left-right direction. That is, while the left through-holes 161L are formed to have the shapes engaging with the engaging projections 233 in the left-right direction, the right through-holes 161R are formed to be larger than the engaging projections 233 in the left-right direction.

Figure 8:
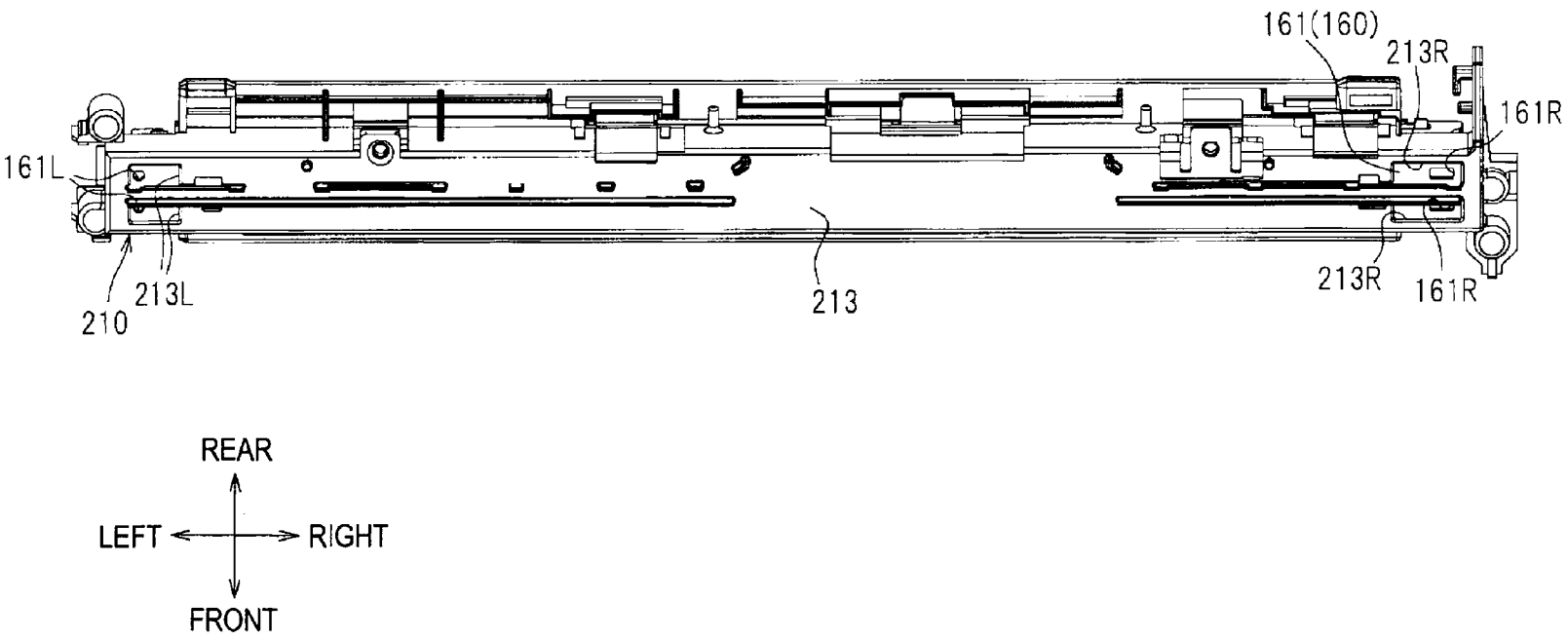
FIG. 8 illustrates a state where the first cover member is mounted to the stay, which is seen from just above.

As shown in FIG. 8, the respective through-holes 161L, 161R are smaller than the respective openings 213L, 213R formed at the first cover member 210 and are exposed through the respective openings 213L, 213R.

Thereby, at a state where the respective engaging projections 233 are engaged into the respective through-holes 161L, 161R, even when the stay 160 is expanded in the left-right direction due to the heat with respect to the pair of third cover members 230 that is not moved in the left-right direction, it is possible to suppress the engaging projections 233 from interfering with ends of the right through-holes 161R because the right through-holes 161R are the long holes. Therefore, it is possible to suppress the stress from being applied to the stay 160 or third cover members 230.

Also, the respective openings 213L, 213R are formed as rectangular holes that are long in the left-right direction. Specifically, a length of the left opening 213L in the left-right direction is the same as a length of the left pressing protrusion 232 in the left-right direction, and a length of the right opening 213R in the left-right direction is set to be larger than a length of the right pressing protrusion 232 in the left-right direction.

In other words, the left opening 213L is formed to have the shape engaging with the pressing protrusion 232 in the left-right direction, and the right opening 213R is formed to be larger than the pressing protrusion 232 in the left-right direction. Thereby, even when the first cover member 210 is expanded in the left-right direction due to the heat, it is possible to absorb the thermal expansion of the first cover member 210 because the right opening 213R is larger than the pressing protrusion 232 in the left-right direction. Therefore, it is possible to suppress the stress from being applied to the first cover member 210 or third cover members 230.

In the meantime, this disclosure is not limited to the above illustrative embodiment and can be used variously, as described below.

In the above illustrative embodiment, the sheet S such as cardboard, postcard, thin paper and the like has been exemplified as the recording sheet. However, this disclosure is not limited thereto. For example, an OHP sheet may be also used.

In the above illustrative embodiment, the pressing roller 140 has been exemplified as the backup member. However, this disclosure is not limited thereto. For example, a belt-type pressing member may be also used.

In the above illustrative embodiment, the nip plate 130 has been exemplified as the nip member. However, this disclosure is not limited thereto. For example, a thick member other than the plate shape may be also adopted.

In the above illustrative embodiment, the halogen lamp 120 has been exemplified as the heat generation member. However, this disclosure is not limited thereto. For example, a heat generation resistance member may be also adopted.

In the above illustrative embodiment, two pairs of the left and right openings 213L, 213R have been provided. However, this disclosure is not limited thereto. For example, the left and right openings may be provided in one pair or three or more pairs.

In the above illustrative embodiment, the through-holes 161L, 161R have been exemplified as the engaging hole. However, this disclosure is not limited thereto. For example, a cylindrical recess having a bottom may be used as the engaging holes. Also, the shape of the engaging projection or engaging hole or the shape of the pressing protrusion or opening is not limited to the above illustrative embodiment and any shape may be adopted.

What is claimed is:

1. A fuser unit, which heat-fixes a developer image on a recording sheet, the fuser unit comprising:

a cylindrical member having flexibility;

a heat generation member that is arranged inside of the cylindrical member;

a nip member that is arranged inside the cylindrical member and configured to receive radiation heat generated from the heat generation member;

a stay that supports the nip member while surrounding the heat generation member;

a first frame that is arranged at an opposite side to the nip member with respect to the stay;

a second frame that is arranged at an opposite side to the stay with respect to the first frame; and a wiring that extends in an axial direction of the cylindrical member between the first frame and the second frame, wherein the first frame is provided with a pair of openings through which both axial end sides of the stay are exposed, wherein the second frame is configured to cover a central portion of the wiring, which is positioned more inwardly than the pair of openings in the axial direction, wherein both axial sides of the second frame are provided with pressing protrusions that directly press the stay through the openings, and wherein both axial sides of the second frame are provided with third frames that cover a part of the wiring arranged at both axial end sides of the first frame.

2. The fuser unit according to claim 1, wherein a fourth frame covering the wiring exposed through gaps between the second frame and the third frames is provided to overlap with the second frame and the third frames.

3. The fuser unit according to claim 1, wherein both axial end sides of the stay are formed with engaging holes, into which engaging projections formed at the pressing protrusions of the third frames are fitted, and which are exposed through the openings, wherein one engaging hole of the respective engaging holes, which is positioned at one axial end side of the stay, is formed to have a shape engaging with a corresponding engaging projection of the engaging projections in the axial direction, and wherein the another engaging hole of the respective engaging holes, which is positioned at the other axial end side of the stay, is formed to be larger than a corresponding engaging projection of the engaging projections in the axial direction.

4. The fuser unit according to claim 1, wherein one opening of the pair of openings, which is positioned at one axial end side of the stay, is formed to have a shape engaging with a corresponding pressing protrusion of the pressing protrusions in the axial direction, and wherein another opening of the pair of openings, which is positioned at the other axial end side of the stay, is formed to be larger than a corresponding pressing protrusion of the pressing protrusions in the axial direction.

5. The fuser unit according to claim 1, wherein an end restraint member is separately provided from the third frames to restrain a position of an end of the cylindrical member.

6. The fuser unit according to claim 1, wherein a pair of end portion guides is separately provided from the third frames to guide inner peripheries of both end portions of the cylindrical member.

7. The fuser unit according to claim 1, wherein a pair of end portion guides is integrally formed with the second frame, wherein the first frame is provided with an upstream guide to guide the cylindrical member to an upstream side of the nip member, in a rotating direction of the cylindrical member, and wherein the pair of end portion guides is adjacent to the upstream guide in the rotating direction.

8. A fuser unit, which heat-fixes a developer image on a recording sheet, the fuser unit comprising:

a cylindrical member having flexibility;

a nip member that slidingly contacts an inner periphery of the cylindrical member;

a backup member that forms a nip portion by sandwiching the cylindrical member between the nip member and the backup member and that rotates together with the cylindrical member;

an upstream guide that is provided at an upstream side of the nip portion in a rotating direction of the cylindrical member to guide the cylindrical member toward the nip portion; and an end restraint member having a restraint surface that restrains a position of an end of the cylindrical member, wherein the upstream guide is formed to protrude more outwardly than the restraint surface in an axial direction of the cylindrical member.

9. The fuser unit according to claim 8, wherein a surface of the upstream guide, which slidingly contacts the cylindrical member, has a surface shape conforming to at least a portion of the inner periphery of the cylindrical member.

10. The fuser unit according to claim 8, wherein an end portion of the upstream guide, which is positioned at a downstream side in the rotating direction, is linear.

11. The fuser unit according to claim 8, wherein an upstream side of the upstream guide in the rotating direction is provided with a pair of end portion guides that slidingly contacts inner peripheries of both end portions of the cylindrical member to guide the cylindrical member toward the upstream guide.

12. The fuser unit according to claim 11, wherein an end portion of the upstream guide, which is positioned at an upstream side in the rotating direction, is arranged more inwardly of the cylindrical member in a diametrical direction than end portions of the pair of end portion guides positioned at a downstream side in the rotating direction.

13. The fuser unit according to claim 8, wherein the cylindrical member is a metal belt, which is configured by a base member made of metal and a resin that covers an outer periphery of the base member.

14. The fuser unit according to claim 8, wherein the upstream guide is made of resin.

15. The fuser unit according to claim 8, wherein the cylindrical member is configured to diametrically move.

* * * * *